United States Patent [19]

Ewing et al.

[11] Patent Number: 5,008,707

[45] Date of Patent: Apr. 16, 1991

[54] SIMULTANEOUS CHARGING AND EXPOSURE FOR PICTORIAL QUALITY

[75] Inventors: Joan R. Ewing, Fairport; Donald E. Wiedrich, Ontario, both of N.Y.

[73] Assignee: Xerox Corporation, Stamford, Conn.

[21] Appl. No.: 402,729

[22] Filed: Sep. 5, 1989

[51] Int. Cl.[5] ..... G03G 15/02; G03G 15/04

[52] U.S. Cl. ..... 355/220; 355/225

[58] Field of Search ..... 355/214, 220, 225, 216; 250/324–326; 430/55; 361/229, 230

[56] References Cited

U.S. PATENT DOCUMENTS

| | | | |
|---|---|---|---|
| 3,307,034 | 2/1967 | Bean | 250/324 |
| 3,886,416 | 5/1975 | Gallo, Jr. | 361/229 |
| 4,298,669 | 11/1981 | Marushima et al. | 430/55 |
| 4,311,778 | 1/1982 | Kadowaki et al. | 430/55 X |
| 4,372,669 | 2/1983 | Fantuzzo et al. | 355/224 |
| 4,444,859 | 4/1984 | Mimera | 430/54 |
| 4,841,146 | 6/1989 | Gundlach et al. | 361/230 X |

FOREIGN PATENT DOCUMENTS

| | | | |
|---|---|---|---|
| 61-80177 | 4/1986 | Japan | 355/220 |

OTHER PUBLICATIONS

Xerox Disclosure Journal Writeup for Donald C. Van Horne et al., titled "Xerographic Cycling Process", vol. 5, No. 4, Jul./Aug. 1980.

*Primary Examiner*—Joan H. Pendegrass

[57] ABSTRACT

Apparatus and method for forming an electrostatic latent image on an imaging member having a photoconductive insulating layer has a voltage sensitive corona charging device with a corona generating electrode and a control electrode positioned in charging relationship to the photoconductive insulating layer, means to energize the charging device to charge the photoconductive insulating layer to a first level comprising means to apply a corona generating voltage to the corona generating electrode and to apply a control voltage of a first magnitude to the control electrode, and means to expose the photoconductive insulating layer to an image pattern simultaneously while the charging device is energized.

11 Claims, 3 Drawing Sheets

SIMULTANEOUS CHARGING AND EXPOSURE FOR PICTORIAL QUALITY

BACKGROUND OF THE INVENTION

The present invention relates to electrostatographic reproducing methods and apparatus and more particularly to methods and apparatus for enhanced reproduction of pictorial quality.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charge carrier particles and charged toner particles which triboelectrically adhere to the carrier particles. During development, the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

This process is basically a high contrast image process in that it is capable of the reproduction of line copy wherein toner is deposited in image areas and not deposited in non-image areas. Accordingly, it does not provide good reproduction of photographic images wherein there is a gradation of color, a gray scale throughout the image. This is in part due to the characteristics of the materials used as the photoconductive insulating layers during exposure in that exposure to a little light for a short period of time results in a fast discharge to a very low level of charge. As a result the electrostatic latent image so produced results in image areas of high charge and non-image areas of very low charge despite the fact that there may be several gradations of color in the original document being reproduced. This characteristic may be represented graphically by a photo-induced discharge curve which is a plot of photoconductor plate surface potential versus the log of exposure. If this curve has a relatively steep slope it means that the photoconductive insulating layer will discharge rapidly with a relatively small increment of light above the threshold at which the first detectable change in potential is detected. Accordingly, in order to be able to reproduce gradations of color, a flat or relatively small slope of this curve is desired which thereby provides more discriminating information as to the gradations of color in the original document that it is desired to reproduce. This range of exposure from black to white in a developed image, which is referred to as the dynamic range, is desired to be as long as possible to provide a more discriminating gradation of charge corresponding to gradation in light intensity which corresponds to gradation in the image.

The xerographic reproduction of material with graded tonal values such as continuous tone or screened pictures or other uniform solid areas may be obtained by breaking up the electrostatic latent image into a series of parallel lines or dots separated by discharged areas and thereby introduce fringing electrostatic fields which are of developable magnitude. Although the solid areas are broken up into a pattern of parallel lines or dots, they can have sufficiently close spacing so that the line structure is not readily discernible to the unaided eye. For example, after conventional charging and exposure the photoconductor is exposed a second time to a white dot pattern or a to a bar pattern of light having high contrast and well defined edges. As a result of the second exposure, the previously unexposed or partially exposed areas of the plate are discharged in the line or dot pattern. The exposed areas will be unchanged from the level to which they were discharged during the first exposure thus strong electric fields are set up which are developable by conventional methods. Screen patterns of a 100 to 200 lines per inch are typically used in this procedure. However, since this technique requires the use of a screen and a second exposure step the final print may be of reduced image density and sharpness.

Prior Art

U.S. Pat. No. 3,307,034 to Bean describes a two-wire corona discharge system for single step electrostatic image formation wherein two parallel corona discharge electrodes are positioned in charging relationship to a xerographic plate and are energized by an alternating current power source while an optical image is focused onto the surface of the xerographic plate.

U.S. Pat. No. 3,886,416 to Gallo describes a method and apparatus for adjusting corotron current wherein the corotron is provided with a light for illumination of the photoconductive surface when corona current is to be tested or adjusted. The lamp is energized during test to put the photoconductor into the conductive state.

Xerox Disclosure Journal, Vol. 5, No. 4, July/August 1980, Page 463, "Xerographic Cycling Process", Von-Hoene et al., describes a cyclical electrostatic imaging method wherein a photoconductive layer with an insulating overcoating is first simultaneously exposed to an optical image while electrically charging with a positively biased AC corotron followed by uniform exposure and simultaneous erasing of the electrostatic image on the photoreceptor and uniformly charging the overcoating to a positive potential.

SUMMARY OF THE INVENTION

In accordance with a principle aspect of the present invention, methods and apparatus for forming electrostatic latent images as well as producing xerographic prints are provided wherein a photoconductive insulating layer is simultaneously charged by a voltage sensitive corona charging device while being exposed to an image pattern. The term voltage sensitive corona charging device" is intended to define charging devices which are sensitive to the difference in voltage on the photoconductor directly underneath it from its reference voltage and will provide greater charge in the more exposed than the less exposed areas. Examples include scorotrons, which have a control electrode such as a grid, and dicorotrons, which have a control electrode such as a shield, in addition to the corona generating electrode.

In a further aspect of the present invention the voltage sensitive corona charging device is energized to charge the photoconductive insulating layer to a first level by applying a corona generating voltage to the corona generating electrode and a control or reference voltage of a first magnitude to the control electrode.

In a further aspect of the present invention, the photoconductive insulating layer is precharged to a level greater than the first level before the voltage sensitive corona charging device is energized with simultaneous exposure.

In a further aspect of the present invention a second voltage sensitive corona discharge device having a corona generating electrode and a control electrode is provided in charging relationship to the photoconductor downstream of the first charging device and is energized to apply a control voltage to the control electrode of a magnitude less than the first magnitude.

In a further aspect of the present invention the voltage sensitive corona discharge device is a scorotron with screen control grid, the grid being divided into two portions, one having applied thereto a control voltage of a first magnitude and the other portion having applied thereto a control voltage less than the first magnitude.

In a further aspect of the present invention, the electrostatic latent image is developed and transferred and fixed to a print substrate.

Other features of the present invention will become apparent as the following description proceeds and upon reference to the drawings.

BRIEF DESCRIPTION OF THE DRAWINGS

FIG. 2 illustrates a single step simultaneous charge and exposure of the photoconductor;

FIG. 3 illustrates a two-step formation of the electrostatic latent image wherein following simultaneous charging and exposure the photoconductor is recharged with a voltage sensitive corona charging device.

FIG. 4 an alternative embodiment wherein prior to simultaneous charging and exposure, the photoconductor is uniformly charged.

DETAILED DESCRIPTION OF THE PREFERRED EMBODIMENT

The invention will now be described with reference to a preferred embodiment of an electrostatographic reproducing apparatus employing same.

Figure 1:
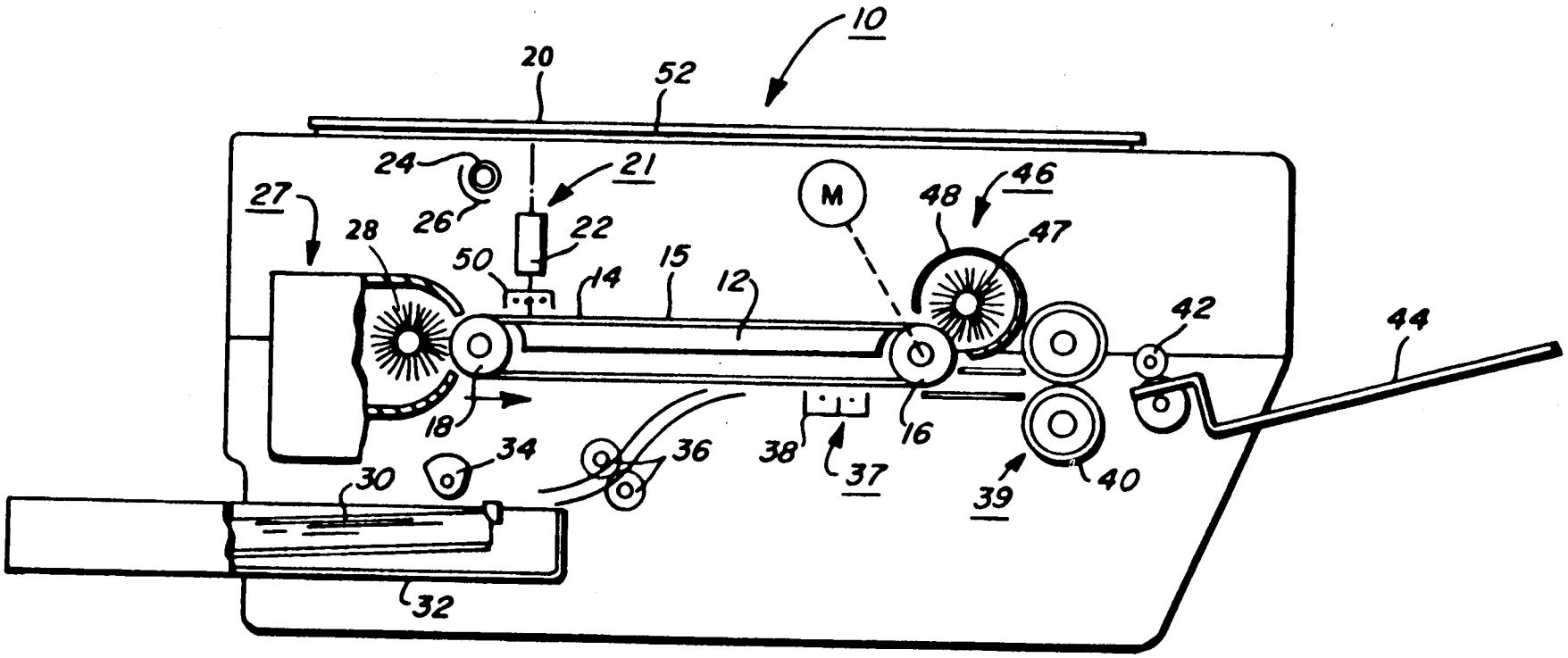
FIG. 1 is a schematic representation in cross section of a xerographic printing machine employed in the practice of the present invention.

Referring now to FIG. 1, there is shown by way of example, an automatic electrostatographic reproducing machine 10 which includes a removable processing cartridge comprising a photoreceptor belt according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiments shown herein.

The reproducing machine 10 illustrated in FIG. 1 employs a removable processing cartridge 12 which may be inserted and withdrawn from the main machine frame from the front. Cartridge 12 includes an image recording belt like member 14 the outer periphery of which is coated with a suitable photoconductive material 15. The belt is suitably mounted for revolution within the cartridge about driven transport roll 16, and idler roll 18 and travels in the direction indicated by the arrow on the outer run of the belt to bring the image bearing surface thereon past the plurality of xerographic processing stations. Suitable drive means such as motor M are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging and exposure station 19 wherein the belt is uniformly charged with an electrostatic charge placed on the photoconductive surface by charge a scorotron 50 and simultaneously exposed to the light image of the original input scene information, whereby the charge is selectively dissipated in the light exposed regions to record the original input scene in the form of electrostatic latent image. Exposure may be through the scorotron and may use a bundle of image transmitting fiber lenses 22 produced under the tradename of "SELFOC" by Nippon Sheet Glass Company Limited, together with an illuminating lamp 24 and a reflector 26. After simultaneous charging and exposure of the belt 15 the electrostatic latent image recorded on the photoconductive surface 15 is transported to development station 27, wherein developer is applied to the photoconductive surface of the drum 15 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator, segmented feed roll 34, feeds individual sheets therefrom to the registration pinch roll pair 36. The sheet is then forwarded to the transfer station 37 is proper registration with image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the roll 16, with the sheet containing the toner image thereon which is advanced to fixing station 39 wherein roll fuser 40 fixes the transferred powder image thereto. After fusing the toner image to the copy sheet, the sheet 30 is advanced to output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation are removed from the belt 14 by the cleaning station 46 which comprises a rotatable cleaning brush 47 in wiping contact with the outer periphery of the belt 14 and contained within cleaning housing 48. Alternatively, the toner particles may be cleaned from the photoconductive surface by a cleaning blade as is well known in the art.

Normally when the copier is operated in the conventional mode, the original document 20 to be reproduced is placed image side down upon a horizontal transport viewing platen 52 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can be used in accordance with the present invention.

Figure 2:
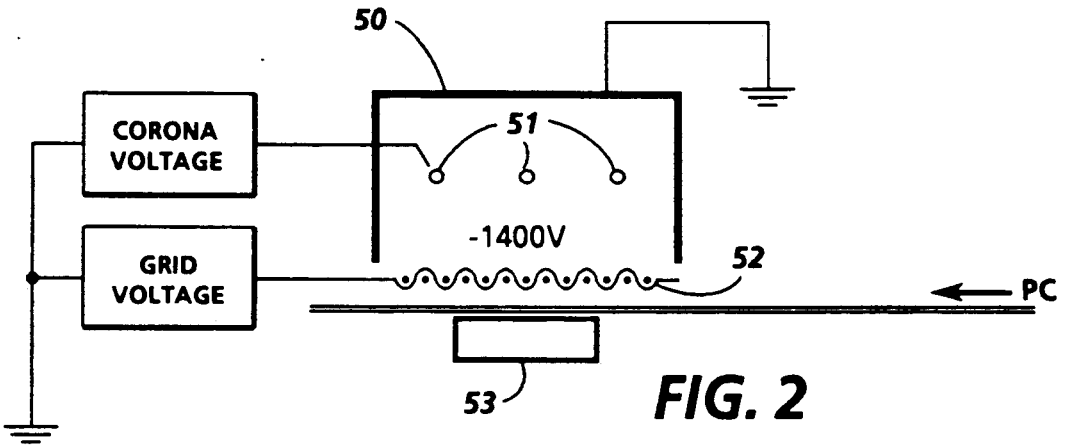
FIGS. 2, 3 and 4 are schematic representations of alternative embodiments of the present invention. In particular
Figure 3:
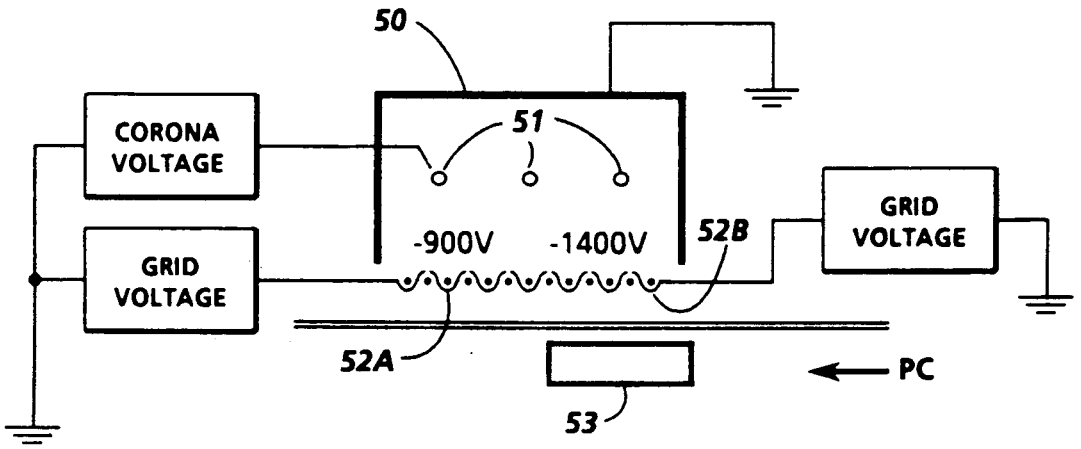
Figure 4:
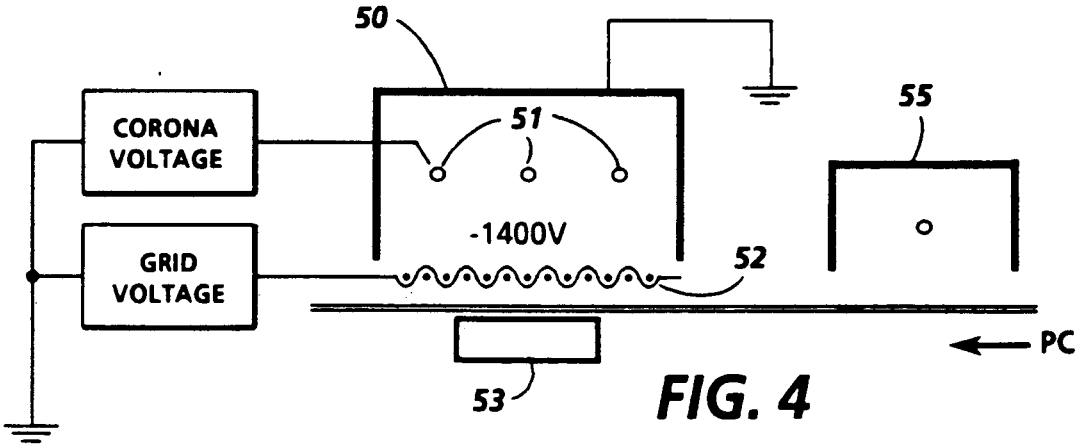

FIGS. 2, 3 and 4 illustrate alternative embodiments of the present invention wherein a photoconductive insulating member is simultaneously charged by a voltage sensitive corona charging device and exposed to an image pattern. By the term "voltage sensitive charging device" we intend to define charging devices wherein the output of the device depends on the voltage of the photoconductor under it. With a charging device which is sensitive to the difference in voltage on the photoconductor directly underneath it from its reference voltage, the charging device will provide a greater charge on the photoconductor in the more exposed than the less exposed areas and provide the greatest charge in the areas receiving the most exposure. The concept of a voltage sensitive charging device may be best understood with reference to a typical device such as a scorotron as described by Walkup in U.S. Pat. No. 2,777,957 wherein the maximum surface poetential may be limited to a predetermined value which is essentially independent of the characteristics of the photoconductive material receiving the charge. This is achieved by controlling the potential on a screen control grid which is interposed between the corona wires and the photoconductor. The corona current flowing toward the photoconductive plate is then shared between the grid and the plate. As the plate potential increases more of the current flows to the grid and less to the plate. When the maximum plate potential is reached, essentially all the current flows to the grid and no further charging of the plate takes place. In this way, the scorotron provides good control over the amount of charge applied to a surface. By using such a device which is charging the photoconductor at about the same rate it is being discharged by the simultaneous exposure, there is a tendency to smooth out the slope of the photo-induced discharge curve and thereby extend the range or gradation of color represented in the electrostatic latent image. Another such voltage sensitive corona discharge device is the dicorotron as described in U.S. Pat. No. 4,086,650. This device has as a discharge electrode or coronode a conductive wire which has a relatively thick dielectric coating, such as glass that substantially eliminates conduction current or D.C. charging. The dicorotron has a second electrode or shield adjacent to the coronode electrode rather than a grid and the imaging surface is charged by means of a displacement current or capacitive coupling through the dielectric material. The shield is biased to the reference or control voltage.

These voltage sensitive devices are to be contrasted with the conventional corotron which is not very sensitive to the surface potential of the photoconductor underneath it. In the conventional corotron, the voltage required to control the current is very high the order of 3,000 volts. The current from the corotron is a function of the wire voltage minus the voltage on the photoconductor underneath. Since the wire voltage is so high, thousands of volts, and the voltage on the photoconductor is relatively low, typically hundreds of volts, a corotron is not sensitive to the voltage on the photoconductor. Therefore, a corotron delivers about the same amount of charge in the more exposed areas as in the less exposed areas. This produces a tendency to merely shift the whole photo-induced discharge curve upwardly rather than change the slope and smooth it out.

According to the present invention a voltage sensitive corona charging device having a corona generating electrode and a control electrode is positioned in charging relationship to a photoconductive insulating layer. The charging device is energized by applying a corona generating voltage to the corona generating electrode and a control voltage to the control electrode. Simultaneously with charging the photoconductive insulating layer is exposed to an image pattern. Depending on the process speed and other operating parameters the corona generating wire of a scorotron typically has a voltage of positive or negative 6 to 7 KV applied while the control grid typically has applied to it a voltage of positive or negative 500 to 1500 volts. The coronode of a dicorotron typically has a voltage of positive or negative 6.5 to 7 KV rms applied while the shield has a voltage applied to it of positive or negative 700 to 1500 volts.

Any suitable photoconductive insulating layer may be employed in the practice of the present invention. One conventional structure for a xerographic plate comprises a photoconductive insulating layer such as selenium or an alloy thereof on a conductive substrate. In the dark, the photoconductive insulating layer is a good insulator and when exposed or illuminated becomes a good conductor. Alternatively, a multi-layered electro-conductive imaging photoreceptor may comprise at least two electrically operative layers, a photogenerating layer or charge generating layer and a charge transport layer which are typically applied to the conductive layer. For further details of such a layer attention is directed to U.S. Pat. No. 4,265,990. In both of these general types of devices there is no overcoating of the photoconductive insulating layer by a separate protective layer or separate insulating layer which could interfere with the practice of the present invention.

Illustrated more specifically in FIGS. 2, 3 and 4, are three Figures of scorotron 50 with three corona generating wires 51, a control grid 52 and an electro luminescent lamp strip 53. The lamp may be used to illuminate portions of the backside of a photoreceptor (moving in the direction of the arrow) having a transparent substrate such as is described in the above referenced U.S. Pat. No. 4,265,990. FIG. 2 demonstrates only a single step of simultaneously charging with a voltage sensitive corona discharge device and exposure. FIG. 3 illustrates an alternative embodiment of a two-step process wherein the control grid of the scorotron is broken into two portions 52A and 52B. Portion 52B is biased at a higher negative potential (−1400 volts) than 52A (−900 volts) and is the location where simultaneous exposure and charging takes placed. In this embodiment 52A, the second or downstream segment of the scorotron with the lower negative potential control grid recharges the photoreceptor. However, more charge is delivered to those areas more completely discharged during the portion 52B simultaneous charge and exposure. FIG. 4 illustrates an alternative embodiment wherein the two-step imaging process includes a precharging of the photoconductor to a level above the level placed on the photoreceptor during the subsequent simultaneous charge and exposed step. Since the initial charging takes place without any exposure, it is not necessary to have a voltage sensitive device and accordingly a conventional corotron 55 can be used. In each of FIGS. 2, 3 and 4 it should be noted that while the illumination of the photoconductive insulating layer has been through a transparent substrate, it is contemplated that the exposure of the photoreceptor may take place in a manner described by the above reference Bean patent or indeed through the scorotron.

The output of the voltage sensitive device depends on the voltage of the photoreceptor under it. The current density to the photoreceptor being exposed should be a function of exposure, not a function of the potential on the wire alone as in a corotron. In the two-step processes of FIGS. 3 and 4, the first charging step must be the highest of the two or otherwise its effects will be completely dominated or erased in the second charging step.

Figure 5:
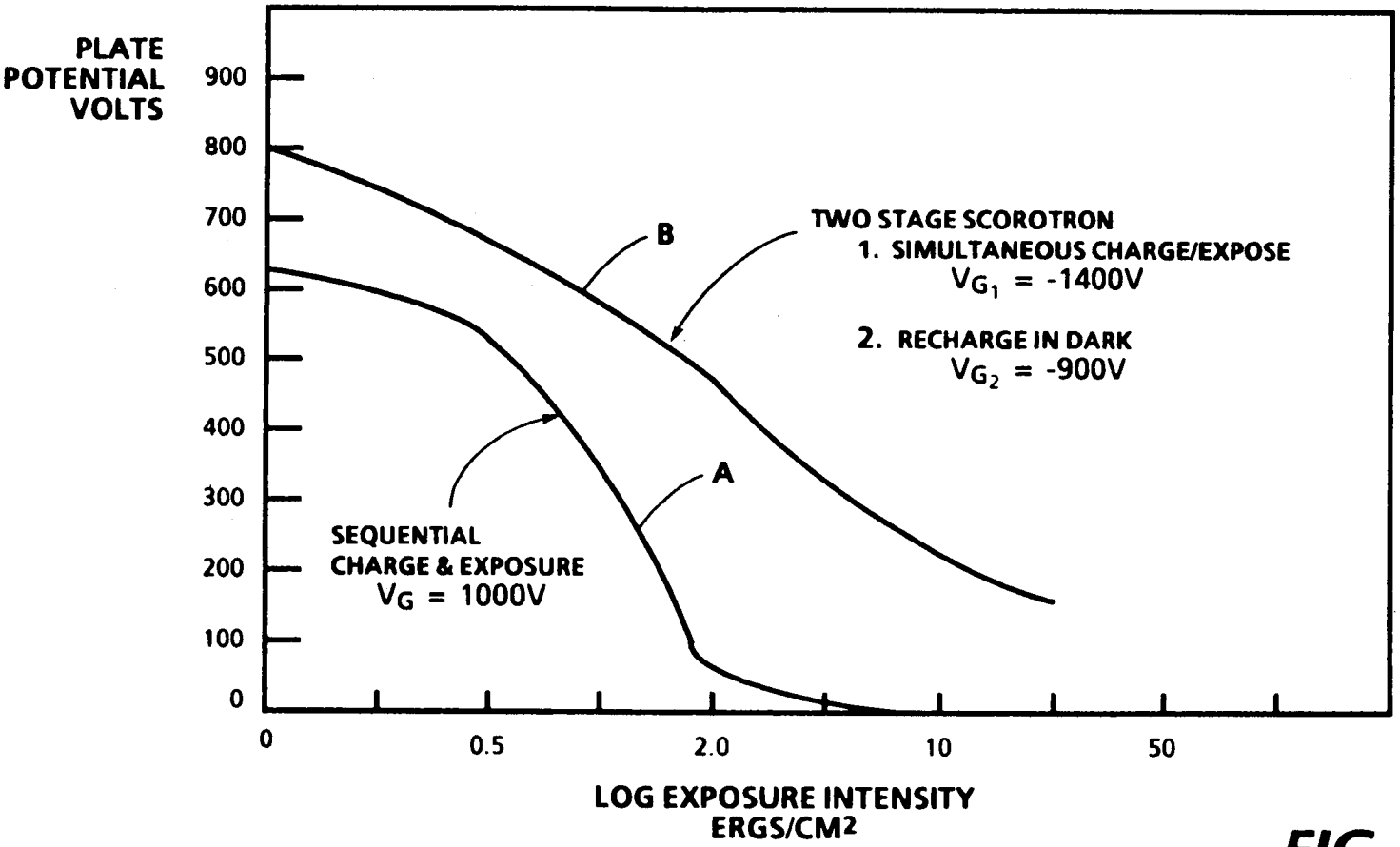
FIG. 5 is a graphical representation and comparison of the photo-induced discharge curve for sequential charging and exposure and simultaneous charging and exposure.

FIG. 5 has photo-induced discharge curves A and B. Curve B represents the curve obtained with the technique described with reference to FIG. 3 wherein a photoconductive insulating layer, as described in the above referenced U.S. Pat. No. 4,265,990, was initially simultaneously exposed and charged by the first portion of the scorotron and an electroluminescent lamp. A potential of −7 KV was applied to all three scorotron wires and a potential of −1400 volts placed on the first grid portion. The second grid portion of the scorotron has a grid potential of −900 volts. Curve A represents the photo-induced discharge curve for the same apparatus wherein the electro luminescent strip was moved downstream in the photoreceptor path to permit conventional sequential charge and subsequent exposure. A negative potential of −7 KV was placed on all the corona generating wires and a negative potential of −1000 volts was placed on the entire control grid. A comparison of curves A and B readily shows that the slope of curve B, according to practice of the present invention has been smoothed out substantially thus significantly extending the dynamic developability range from black and white to black, different levels of gray and white. The ratio of initial light intensity to final light intensity (dynamic range) has been extended 25 times from about 0.5 to 2, a ratio of 4 to 1, to about 0.5 to 50, a ratio of about 100 to 1.

The photo-induced discharge curves A and B show the slope and latitude of the entire sensitivity profile from the initial threshold to the saturation point. These curves demonstrate that the technique according to the present invention, illustrated by Curve B, maintains a sensitivity to light intensity over a wider range and thereby provides enhanced continuous tone and pictorial reproduction.

The disclosures of the patents referred to herein are hereby specifically and totally incorporated herein by reference.

While the invention has been described with reference to specific embodiments, it will be apparent to those skilled in the art that many alternatives, modifications and variations may be made. Accordingly, it is intended to embrace all such alternatives, modifications as may fall within the spirit and scope of the appended claims.

We claim:

1. Apparatus for forming an electrostatic latent image on an imaging member having a photoconductive insulating layer comprising a voltage sensitive corona charging device having a corona generating electrode abnd a control electrode positioned in charging relationship to said photoconductive insulating layer, means to energize said charging device to charge said photoconductive insulating layer to a first level comprising means to apply a corona generating voltage to said corona generating electrode and to apply a control voltage of a first magnitude to said control electrode, means to expose said photoconductive insulating layer to an image pattern simultaneously while said charging device is energized, a second voltage sensitive corona discharge device having a corona generating electrode and a control electrode in charging relationship to said photoconductive insulating layer downstream of said first voltage sensitive corona charging device, and means to energize said second voltage sensitive corona discharge device to apply a control voltage to said control electrode of a magnitude less than said first magnitude.

2. The apparatus of claim 1 wherein said voltage sensitive corona charging device is a scorotron.

3. The apparatus of claim 1 wherein said voltage senitive corona charging device is a dicorotron.

4. The apparatus of claim 1 including means to precharge said photoconductive insulating layer to a level greater than said first level before said voltage sensitive corona discharge device is energized with simultaneous exposure.

5. The apparatus of claim 1 wherein said voltage sensitive corona discharge device and said second voltage sensitive corona discharge device comprise a scorotron with a screen control grid, said grid being divided into two portions, one portion having applied thereto a control voltage of said first magnitude and the other portion having applied thereto a control voltage less than said first magnitude.

6. Apparatus for producing xerographic prints comprising means for forming an electrostatic latent image on an imaging member having a photoconductive insulating layer comprising a voltage sensitive corona charging device having a corona generating electrode and a control electrode positioned in charging relationship to said photoconductive insulating layer, means to energize said charging device to charge said photoconductive insulating layer to a first level comprising means to apply a corona generating voltage to said corona generating electrode and to apply a control voltage of a first magnitude to said control electrode, means to expose said photoconductive insulating layer to an image pattern simultaneously while said charging device is energized to form an electrostatic latent image of said image pattern, a second voltage sensitive corona discharge device having a corona generating electrode and a control electrode in charging relationship to said photoconductive insulating layer downstream of said first voltage sensitive corona charging device, and means to energize said second voltage sensitive corona discharge device to apply a control voltage to said control electrode of a magnitude less than said first magnitude.

7. The apparatus of claim 6 including means to transfer said developed image of marking material to a first substrate and means to fix said transferred image to said substrate.

8. The apparatus of claim 6 wherein said voltage sensitive corona charging device is a scorotron.

9. The apparatus of claim 6 wherein said voltage sensitive corona charging device is dicorotron.

10. The apparatus of claim 6 including means to precharge said photoconductive insulating layer to a magnitude greater than said first magnitude before said voltage sensitive corona discharge device is energized with simultaneous exposure.

11. The apparatus of claim 6 wherein said voltage sensitive corona discharge device and said second voltage sensitive corona discharge device comprise a scorotron with a screen control grid, said grid being divided into two portions, one portion having applied thereto a control voltage of said first magnitude and the other portion having applied thereto a control voltage less than said first magnitude.

* * * * *